United States Patent [19]

Compton et al.

[11] 4,385,945

[45] May 31, 1983

[54] LIFT-OFF MEANS AND METHOD FOR USE WITH A HORIZONTAL CONTINUOUS HEARTH ROLL FURNACE FOR THE TREATMENT OF METALLIC STRIP

[75] Inventors: Thomas A. Compton, Middletown; Fred Byrd, Lebanon, both of Ohio

[73] Assignee: Armco Inc., Middletown, Ohio

[21] Appl. No.: 322,760

[22] Filed: Nov. 19, 1981

[51] Int. Cl.[3] ..... C21D 9/56

[52] U.S. Cl. ..... 148/156; 266/103; 266/111; 226/199; 432/8; 432/59

[58] Field of Search ..... 148/156, 155, 153; 266/102, 103, 107, 108, 111–113; 432/8, 59; 226/199

[56] References Cited

U.S. PATENT DOCUMENTS

| | | | |
|---|---|---|---|
| 1,956,401 | 4/1934 | Russ | 432/242 |
| 3,284,073 | 11/1966 | Engelhardt | 432/59 |
| 4,160,677 | 7/1979 | Lukac et al. | 134/9 |

*Primary Examiner*—L. Dewayne Rutledge
*Assistant Examiner*—Christopher W. Brody
*Attorney, Agent, or Firm*—Frost & Jacobs

[57] ABSTRACT

Improved means and method are provided for the guidance of metallic strip in a horizontal continuous furnace having hearth rolls and wherein the strip temperature and furnace atmosphere are such as to promote the transfer of metal, oxides, dirt and the like from the metallic strip to some at least of the hearth rolls. At least one lifting hearth roll is provided in an elevated position wherein it lifts the metallic strip from those critical hearth rolls subject to contamination transfer. The elevated position of the lifting roll and its diameter are so chosen to assure a wrap-around contact between the metallic strip and the lifting roll in its elevated position. In practice the metallic strip is fed through the furnace and continuous operation is begun. The lifting roll, in its elevated position, maintains the metallic strip out of contact with the critical hearth rolls.

16 Claims, 6 Drawing Figures

LIFT-OFF MEANS AND METHOD FOR USE WITH A HORIZONTAL CONTINUOUS HEARTH ROLL FURNACE FOR THE TREATMENT OF METALLIC STRIP

TECHNICAL FIELD

The invention relates to means and a method for the guidance of metallic strip through a horizontal continuous furnace having hearth rolls, and more particularly to the provision and use of a lifting hearth roll to prevent contamination transfer between the metallic strip and the other hearth rolls.

BACKGROUND ART

It must be emphasized from the outset that the teachings of the present invention are applicable to any horizontal continuous furnace for the annealing or heat treating of a metallic strip and having hearth rolls for the support of the metallic strip as it passes therethrough. In the usual practice, the metallic strip is advanced through such a furnace by tension, the hearth rolls being idler rolls. It is not uncommon, however, for some or all of the hearth rolls to be driven, to assist in advancing the strip through the furnace. Under either circumstance, it is a practical impossibility to synchronize the speed of all of the hearth rolls with that of the metallic strip. As a result, there is unavoidable slippage and rubbing between the hearth rolls and the bottom surface of the strip. This slippage and rubbing, in turn, results in metal transfer from the strip to the surface of the hearth rolls. Furthermore, dirt, oxides and the like are often abraded from the bottom surface of the strip and transferred to the hearth roll surfaces. This contaminate transfer from the strip to the hearth roll, once begun, builds up rapidly. The localized build-up of these contaminates on the hearth roll surfaces eventually result in scratching, denting or dinging of the strip surface. It can, indeed, result in irreparable damage to the strip surface, particularly in those instances where the ultimate use of the metallic strip requires a high finish surface.

Instances where the metallic strip is to be coated with a molten coating metal, this damage to the strip surface can result in an unsatisfactory end product. Furthermore, this contaminant build up on the hearth rolls can be transferred back onto the bottom surface of the strip, resulting in uncoated spots or metal lumps on the strip after the strip has passed through a coating bath.

It has further been found that certain furnace atmospheres and elevated temperatures above about 427° C. will tend to promote and accelerate contamination transfer from the strip to the hearth rolls. Under some circumstances, the contamination-coated hearth rolls may tend to stick to the metallic strip causing further damage to its bottom surface.

Horizontal continuous hearth roll furnaces demonstrating the above noted contamination pick-up problem on their hearth rolls are found in various situations. For example, they are found in metallic coating lines. In the fluxless hot dip metallic coating of steel strip it is necessary to subject the surfaces of the strip to a preliminary treatment which provides a clean surface free of iron oxide scale and other surface contaminants and which is readily wettable by the molten coating metal in order to obtain good adherence. In this country, two types of in-line anneal preliminary treatments are in common use. One is the so-called Sendzimir process (or oxidation-reduction practice) disclosed in U.S. Pat. Nos. 2,110,893 and 2,197,622. The other is the so-called Selas process (or high intensity direct fired furnace line) disclosed in U.S. Pat. Nos. 3,320,085 and 3,720,546.

In accordance with the basic Sendzimir process, steel strip is heated in an oxidizing furnace to a temperature of about 370° C. to about 485° C. without atmosphere control. The strip is withdrawn into air to form a controlled surface oxide layer thereon and is thereafter introduced into a reduction furnace containing a hydrogen-nitrogen atmosphere wherein the strip is heated from about 485° to about 925° C. and the controlled oxide layer is completely reduced. The strip is then passed into a cooling section containing a protective reducing atmosphere and is brought approximately to the temperature of the molten coating metal bath. From the cooling section, the strip is led beneath the bath surface while still surrounded by the protective atmosphere.

In the basic Selas process, steel strip is passed through a direct fired preheat furnace section which has a temperature of about 1315° C. by direct combustion of fuel and air to produce gaseous products of combustion containing at least about 3% combustibles in the form of carbon monoxide, the stock reaching a temperature of from about 425° to about 705° C., while maintaining bright steel surfaces completely free from oxidation. The stock is then passed into a reducing section and from the reducing section to a cooling section wherein it is cooled to a temperature approximating the molten coating metal bath temperature. From the cooling section, the strip is again led beneath the surface of the bath while still surrounded by the protective atmosphere of the cooling section.

U.S. Pat. No. 3,936,543 teaches an improvement in the basic Selas process. U.S. Pat. No. 4,123,291 teaches that a sulfur-bearing coke oven gas can be used as a fuel in the directed fired furnace sections of both the Sendzimir and Selas processes.

As exemplary instances of the problem sought to be overcome by the present invention, in all of the coating lines of the above noted patents wherein a horizontal continuous hearth roll furnace is used in the reducing section, contamination transfer to the hearth rolls can occur in approximately the first third of such furnaces. In the remainder of such furnaces, the tendency of contaminant transfer to the hearth rolls is much less since strip surface contaminants have been removed from the strip during approximately the first one-third of the reducing furnace.

Another well known coating line process is the so-called flux process wherein the strip is pretreated to render its surfaces free of oxide and contaminants and is passed through a flux tank, followed by preheating and passing beneath the surface of a molten coating metal bath. Some of these processes involve a chemical cleaning followed by induction heating to about 427° C. before the strip enters the coating pot. Under these circumstances, where the heating is conducted in a horizontal hearth roll furnace, contamination transfer to the hearth rolls can occur.

Some metallic strip treatment processes entail the use of horizontal continuous hearth roll annealing or normalizing furnaces. Such furnaces are normally used in the production of uncoated strip. Usually, the furnace is open at both ends and uses an oxidizing atmosphere in both the heating and cooling sections. Thereafter, the strip is frequently pickled to remove scale after annealing. Under some circumstances, the entire furnace length (with the possible exception of the entry portion) is subject to hearth roll pick-up. This is true because reducing atmospheres are not used and the contaminants are not removed from the strip.

The above are exemplary instances in which the problem to which the present invention is directed can occur. Contamination transfer to hearth rolls and resultant damage to the metallic strip have long been recognized by the worker in the art. Numerous approaches have been taken to avoid or minimize the problem. For example, U.S. Pat. Nos. 2,279,917 and 4,182,635 teach catenary furnaces wherein hearth rolls are eliminated. Such furnaces, however, are more expensive to build and maintain because they are larger and require more building space. Furthermore, the use of cantenary furnaces is not generally an acceptable solution, if non-catenary furnaces already exists.

Another approach is taught by U.S. Pat. No. 3,643,381 and Japanese application No. 126906/74 published May 8, 1976. U.S. Pat. No. 3,649,381 teaches the provision of perforated hearth rolls supplied with an inert gas to provide a film of gas at the interface between the hearth roll and the metallic strip supported thereby. The Japanese published application teaches the directing of pressurized reducing gas onto a hearth roll surface immediately prior to contact with the metal strip and maintaining a reducing gas atmosphere around the roll. This approach, however, requires specially designed rolls or nozzles, together with feed lines and the like for each hearth roll in the furnace subject to contamination transfer.

The present invention is based upon the discovery that in a horizontal continuous hearth roll furnace for the treatment of metallic strip, contamination transfer to the hearth rolls and resulting damage to the strip surface can be avoided by the provision of at least one appropriately placed, hearth roll which will lift the metallic strip off of the remaining critical hearth rolls subject to contamination transfer. Preferably, the lifting roll is vertically shiftable between a down position in alignment with or below the other hearth rolls and an elevated or lifting position. The provision of a vertically shiftable roll within a furnace is not, per se, new. For example, U.S. Pat. No. 1,956,401 teaches the provision of vertically adjustable rolls within a furnace or at its entrance and exits ends to control the amount of sag of a freely hanging band or wire passing through a straight, horizontal furnace. U.S. Pat. No. 3,284,073 teaches an elongated horizontal furnace for stress relief annealing. The furnace is provided with two sets of rollers, the rollers of each set having two axially adjacent working surfaces. The sets of rollers are shiftable both vertically and transversely of the furnace so that fresh roller working surfaces can be brought into contact with the strip being treated, without shutting down the furnace.

DISCLOSURE OF THE INVENTION

According to the invention improved means and a method are provided for the guidance of metallic strip through a horizontal continuous furnace of the type having hearth rolls and wherein the strip temperature and furnace atmosphere are such as to promote the transfer of metal, oxides, dirt and the like from the metallic strip to some at least of the hearth rolls. To this end, at least one lifting hearth roll, preferably driven, is provided. In a preferred embodiment, the lifting roll has an elevating means to shift the lifting roll between a down position and an elevated position. In its down position, the lifting roll is in alignment with the remaining hearth rolls, the metallic strip passing thereover tangentially, or it can be at a level below the level of the remaining hearth rolls. In its elevated position, the lifting roll raises the metallic strip out of contact with those critical hearth rolls subject to contamination transfer. The elevated position of the lifting roll and its diameter are so chosen as to assure a greater than tangential or wrap-around contact between the metallic strip and the lifting roll when the lifting roll is in its elevated position.

In practice, the lifting roll is initially in its down position, the metallic strip is fed through the furnace, and continuous operation is begun. Thereafter, the lifting roll is shifted to its elevated position, lifting the metallic strip off of the critical hearth rolls. The lifting roll rotates, preferably driven, at a speed synchronized with the the speed of the strip which, together with the fact that its contact with the strip is great enough to provide the necessary friction to assure a speed match between the roll and the strip, substantially preclude contamination transfer from the metallic strip to the lifting roll.

In another embodiment of the present invention one or more lifting rolls are again provided. In this instance, however, the lifting roll is permanently mounted in its elevated position and means to shift the lifting roll may be eliminated. During thread-up of the strip through the furnace the strip is cause to pass over the lifting roll or rolls. Under these circumstances the critical hearth rolls may be eliminated. Again the lifting roll is preferably driven and has a wrap-around contact with the strip.

As a result of the practice of the present invention, there will be no sliding contact between the metallic strip and those critical hearth rolls subject to contamination transfer. Thus, transfer of metal, oxide, dirt and the like is eliminated and damage to the surface of the metallic strip caused by such contamination transfer is markedly reduced or eliminated. This, in turn, reduces or eliminates rejection of metallic strips, particularly in instances where a high finish surface is required or desired. Dents, digs, dings and scratches, caused by roll pick up, are eliminated. Frequent roll changes, necessitated by roll pick up, are also eliminated.

The teachings of the present invention are applicable both to newly constructed horizontal continuous roller hearth furnaces and to already existing furnaces of this type.

DETAILED DESCRIPTION OF THE INVENTION

Figure 1:
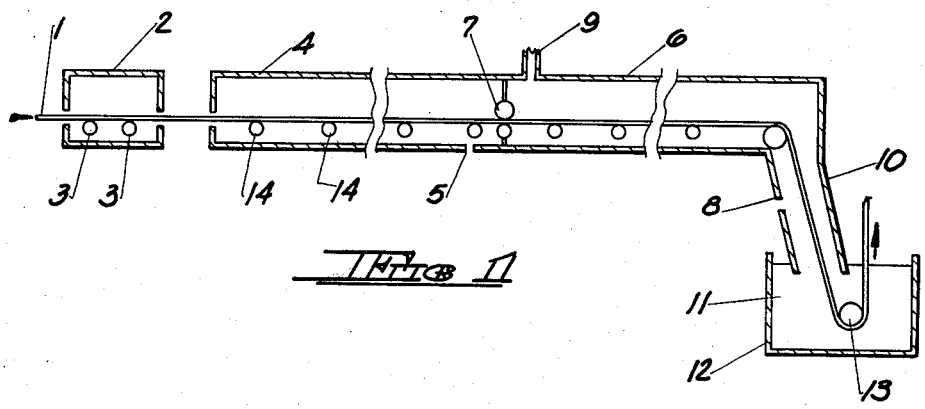
FIG. 1 is a fragmentary, semi-diagrammatic, cross sectional view of a typical metallic coating line having a horizontal continuous roller hearth furnace exemplary of those to which the teachings of the present invention may be applied.

Referring first to FIG. 1, this Figure is a fragmentary, semi-diagrammatic representation of an exemplary coating line having a horizontal continuous roller hearth furnace of the type to which the teachings of the present invention can be applied. Briefly, the metallic strip to be coated is shown at 1. The strip first travels through an oxidizing furnace 2 which is heated to a temperature of about 870° C. by combustion of scrubbed coke oven gas. While oxidizing furnace 2 is illustrated as being of the horizontal continuous roller hearth type, the combination of atmosphere, temperature and residence time of the strip 1 in furnace 2 is not such that the hearth rolls 3 are subject to contamination transfer. From the oxidizing furnace 2, the strip 1 is exposed to the atmosphere and thereafter led into a second horizontal continuous roller hearth furnace 4, constituting a reducing furnace having an inlet 5 for nitrogen. The reducing furnace 4 has a cooling section 6. The cooling section 6 is separated from the reducing furnace 4 by baffle means 7. The cooling section 6 has an inlet 8 for hydrogen and a stack 9 for flaring hydrogen. The cooling section 6 terminates in a protective snout 10 extending beneath the surface of a molten coating metal bath 11 in a coating pot 12.

It will be noted from FIG. 1 that the strip 1, while still in the protective atmosphere of cooling section 6, is led beneath the surface of molten coating metal bath 11 and caused to pass around pot roll 13, exiting bath 11 in a substantially vertical flight. Any conventional finishing means (not shown) may be used for metering and solidifying the coating on strip 1.

The structure of FIG. 1 constitutes a basic Sendzimir system, as described above, modified in accordance with the above mentioned U.S. Pat. No. 4,123,291. In this structure, the metallic strip attains a temperature of from about 760° C. to about 900° C. in the reducing furnace 4 and those hearth rolls 14 located in about the first third of reducing furnace 4 are subject to contamination transfer from the strip with possible consequent damage to the bottom surface of the strip.

Figure 2:
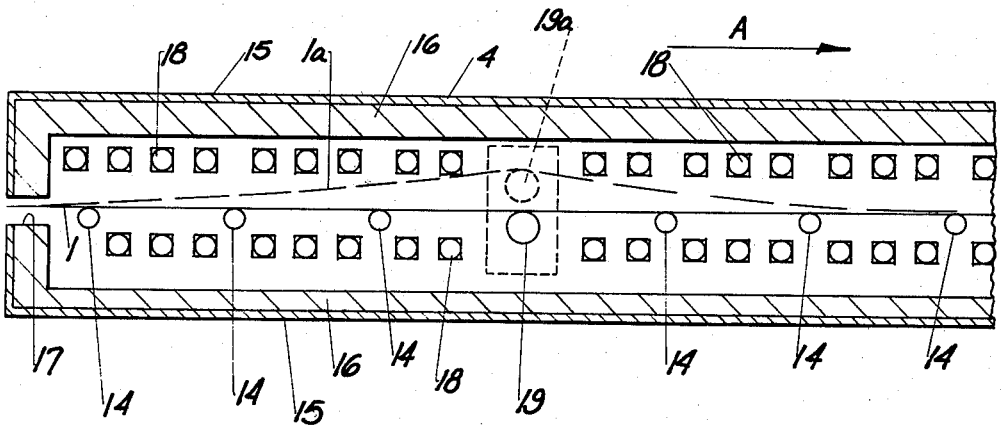
FIG. 2 is a fragmentary, simplified, cross sectional view of a horizontal continuous roller hearth furnace having the lift-off roll of the present invention.

FIG. 2 is a semi-diagrammatic representation of the horizontal continuous hearth roll furnace 4 of FIG. 1 and like parts have been given like index numerals. It will be understood, however, that FIG. 2 could be considered to be a semi-diagrammatic representation of any horizontal continuous hearth roll furnace for any purpose and wherein some or all of the hearth rolls 14 are subject to contamination transfer. The furnace 4 of FIG. 2 is of conventional construction, having an outer metallic frame represented at 15 and a refractory lining, represented at 16. The furnace entrance is shown at 17 with the metallic strip 1 passing therethrough in the direction of arrow A. The furnace 4 is provided with a plurality of hearth rolls 14. In the usual practice, the hearth rolls serve as support for the metallic strip 1 as it passes through furnace 4, the metallic strip contacting hearth rolls 14 substantially tangentially, as shown. Finally, the furnace 4 is provided with a plurality of heating elements 18, in conventional manner. The heating element 18 may constitute gaseous fuel burners or radiant heating elements.

For purposes of this description, FIG. 2 may be considered to diagrammatically represent approximately the first one third of furnace 4. Therefore, the hearth rolls 14 illustrated in FIG. 2 constitute those critical hearth rolls subject to contamination transfer. While the hearth rolls 14 may be driven to assist in the passage of metallic strip 1 through furnace 4, frequently such rolls are simply idler rolls, the metallic strip 1 being pulled through furnace 4.

In accordance with the teachings of the present invention, a lifting roll 19 is located in a selected position (or is used to replace a selected hearth roll in an existing furnace) so that it can lift the metallic strip 1 from the critical hearth rolls 14. Means to be described hereinafter may be provided to shift lifting roll 19 from its down position shown in solid lines in FIG. 2 to its elevated position shown in broken lines at **19*a*. In FIG. 2 the lifting roll 19 is illustrated as being in alignment with rolls 14 when in its down position so that the strip contacts roll 19 tangentially during furnace thread-up. It would be within the scope of the invention to provide a down position for roll 19 in which the roll is below the level of the rolls 14 and is not contacted by the strip during furnace thread-up. It will be noted from FIG. 2 that when the roll 19 is in its elevated position 19*a*, the strip 1 is lifted from critical hearth rolls 14, as shown by broken line 1*a***.

The height of the lifting roll 19 in its uppermost position **19*a* is, of course, limited by such factors as the height of the inside of the furnace and the like. As a result, both the height of the lifting roll in its uppermost position and the diameter of the lifting roll are so chosen as to assure a wrap-around contact between the metallic strip 1 and the lifting roll 19 when in its uppermost position. The term "wrap-around contact", as used herein and in the claims, refers to the fact that the strip contacts an arc of the periphery of roll 19, rather than a tangential contact. This wrap-around contact between lifting roll 19 and metallic strip 1 is of importance from several aspects. First of all, the wrap-around contact between lifting roll 19 in its uppermost position and the metallic strip 1** tends to assure that little or no contamination transfer occurs between the metallic strip and the lifting roll. Furthermore, it assists in achieving synchronization between the speed of the roll and the line speed of the metallic strip.

While under some circumstances the wrap-around contact between the lifting roll 19 in its uppermost position **19*a* and the metallic strip 1** may be sufficient to enable achievement of such synchronization with the lifting roll being an idler roll, it is preferable that the lifting roll be driven.

Figure 3:
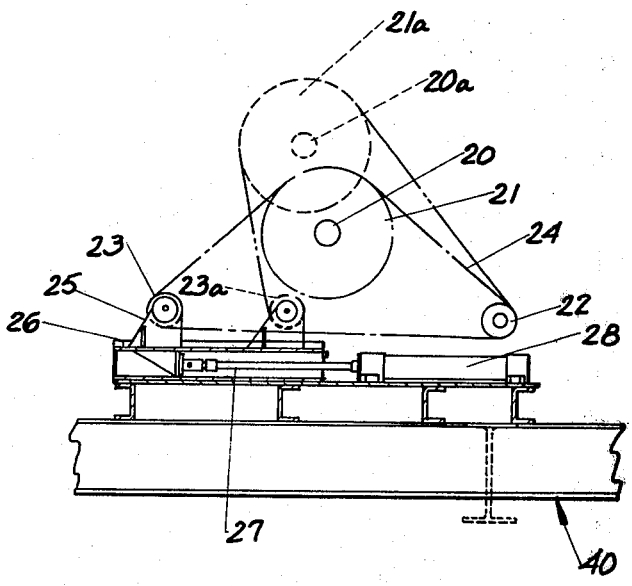
FIGS. 3 and 4 are fragmentary, simplified, elevational views of an exemplary drive mechanism for the lifting roll of the present invention.

Reference is now made to FIG. 3. In FIG. 3 the shaft of lifting roll 19 is shown at 20 in the down position of the lifting roll and at **20*a* in the elevated position of the lifting roll. The shaft 20 extends beyond the confines of furnace 4 (see FIG. 5) and carries at its outermost end a sprocket 21. A driving sprocket is shown at 22, and an idler sprocket is shown at 23. A roller chain 24, or the like, passes about shaft sprocket 21, driving sprocket 22 and idler sprocket 23**.

When the lifting roll 19 is in its down position, idler sprocket 23 is spaced by a considerable distance from driving sprocket 22 to assure proper tension upon roller chain 24. However, when lifting roll 19 is shifted to its elevated position and its sprocket is in the position shown at **21*a*, idler sprocket 23 must shift toward driving sprocket 22 to the position shown at 23*a* to accommodate for the roller chain 24. To enable this movement of idler sprocket 23, the sprocket 23 is mounted on a bracket 25, slidably located in an appropriate way 26. The mounting bracket 25 of idler sprocket 23 is connected to the piston rod 27 of an air or hydraulic cylinder 28. Through the agency of cylinder 28 and the slidable mounting of idler sprocket 23, proper tension can be maintained on roller chain 24 when lifting roll 19** is shifted between its down and elevated positions.

Figure 4:
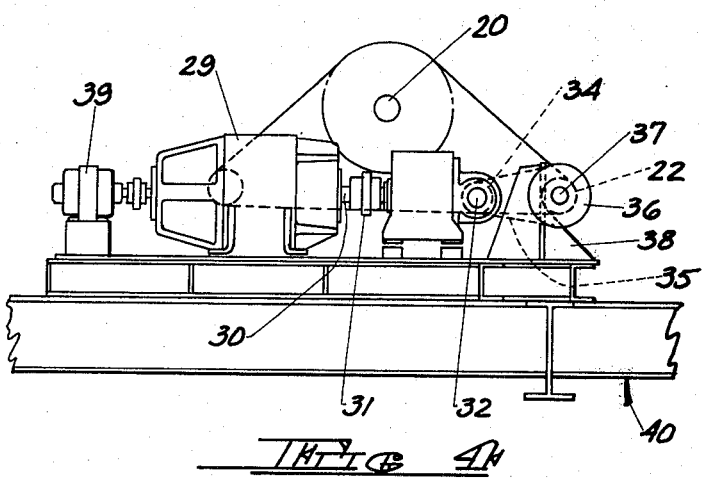

FIG. 4 illustrates an exemplary drive means for drive sprocket 22. An electric motor 29, or other suitable prime mover has its shaft 30 connected, as at 31, to the input of a speed reducer 32. The output shaft 33 of the speed reducer has a sprocket 34 mounted thereon. The sprocket 34 is connected by a roller chain 35, or the like, to another sprocket 36. The sprocket 36, in turn, is mounted on a shaft 37. The shaft 37 is supported by appropriate bracket means 38. The shaft 37 also mounts drive sprocket 22. The motor 29 may be provided with a tachometer 39 to assist in the synchronization of the speed of lifting roll 19 with the line speed of metallic strip 1. All of the described elements of FIGS. 3 and 4 are mounted on suitable support means (generally indicated at 40 in FIGS. 3 through 5) to one side of furnace 4.

Figure 5:
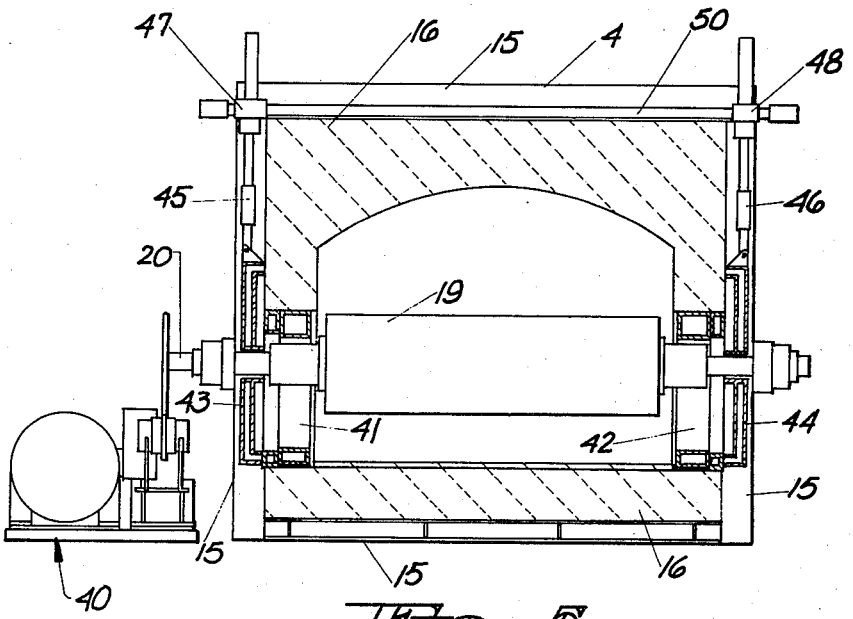
FIG. 5 is a cross sectional view of the horizontal continuous furnace taken adjacent the lifting roll of the present invention.
Figure 6:
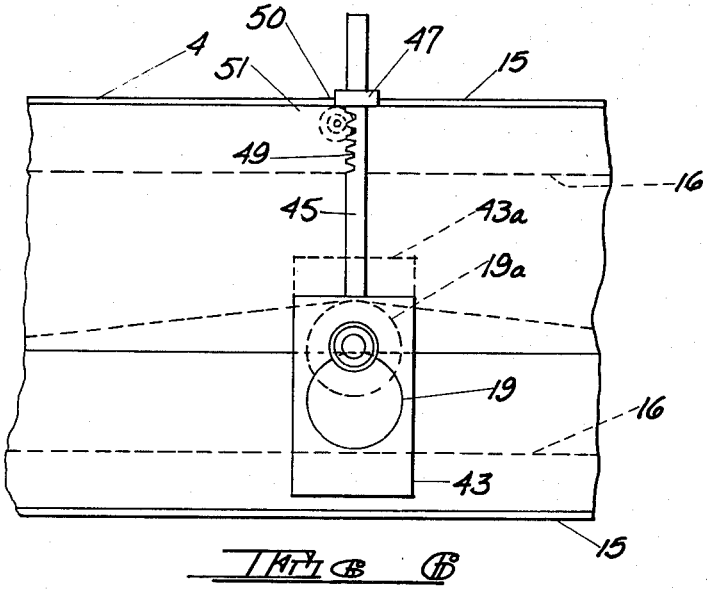
FIG. 6 is a fragmentary, semi-diagrammatic, elevational view of the furnace of FIG. 5, as seen from the right of the Figure.

Reference is now made to FIGS. 5 and 6 wherein exemplary means to raise and lower lifting roll 19 are semi-diagrammatically shown. The side walls of furnace 4 are provided with vertically elongated openings 41 and 42 through which the ends of shaft 20 of lifting roll 19 extend. The ends of shaft 20 are mounted in bearing means 43 and 44 which close the openings 41 and 42, respectively and which are vertically shiftable. In FIG. 5, lifting roll 19 is shown in its uppermost position. In FIG. 6, lifting roll 19 is shown in its down position and in broken lines in its uppermost position at 19*a*. In similar fashion, vertically shiftable bearing means 43 is shown in solid lines in its down position in FIG. 6 and in broken lines in its uppermost position at 43*a*.

A pair of vertical link members 45 and 46 are appropriately affixed to vertically shiftable bearing means 43 and 44, respectively. The vertical link members 45 and 46 each pass through appropriate support members 47 and 48, respectively. Vertical link members 45 and 46 are provided with teeth, the teeth on vertical link member 45 being shown at 49 in FIG. 6.

A shaft 50 is rotatively mounted on furnace 4 and extends transversely thereof. The shaft 50 carries a pair of gears, one of which is shown at 51 in FIG. 6. The gear 51 is meshed with the teeth 49 of vertical link member 45. The other gear (not shown) is similarly meshed with teeth of vertical link member 46.

It will be evident from the described structure that rotation of shaft 50 in one direction will (through the agency of the gears and vertical link members) cause vertically shiftable bearing means 43 and 44 to move upwardly, carrying lifting roll 19 to its uppermost position. Rotation of shaft 50 in the opposite direction will, in similar fashion, result in the lowering of vertically shiftable bearing means 43 and 44 and lifting roll 19 to their down positions. Desired rotation of shaft 50 can be accomplished by any appropriate manual or permanently mounted prime mover (not shown).

As indicated above, in many instances it will not be necessary to lift metallic strip 1 from all of the hearth rolls of the furnace, it being necessary to lift metallic strip 1 only from those critical hearth rolls subject to contamination transfer. On the other hand, the number of critical transfer rolls from which metallic strip 1 should be lifted may be more than can be accomplished by a single lifting roll. It is therefore within the scope of the invention to provide more than one lifting roll.

When more than one lifting roll is used, it is still important that an adequate wrap-around engagement between the lifting rolls and the metallic strip be achieved. To assure this, when more than one lifting roll is used, it may be desirable to provide an intermediate roll beneath which the metallic strip must travel when the lifting rolls are in their elevated positions. This is diagrammatically illustrated in FIG. 7.

Figure 7:
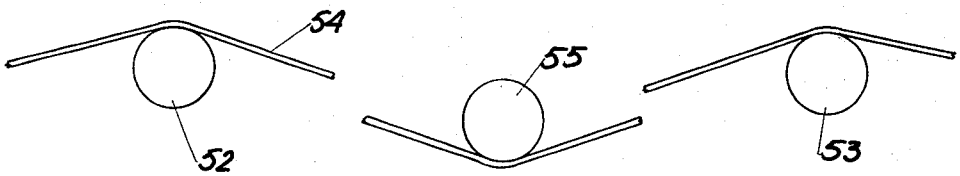
FIG. 7 is a fragmentary, diagrammatic representation of the metallic strip and the use of more than one lifting roll.

In FIG. 7 a pair of lifting rolls, equivalent to lifting roll 19 of FIG. 2, are shown diagrammatically at 52 and 53. Lifting rolls 52 and 53 are raising a metallic strip 54. An intermediate roll is shown at 55. It will be noted that the metallic strip 54 passes over lifting roll 52, beneath intermediate roll 55 and over lifting rolls 53. Lifting rolls 52 and 53 can be in every way equivalent to lifting roll 19 of the previous Figures and preferably are raised and lowered and driven in the manner described above. While intermediate roll 55 could be provided with a stationary mounting, preferably it, too, is shiftable vertically and driven so as to have its speed synchronized with that of metallic strip 54.

In the practice of the present invention, the metallic strip is fed through furnace 4 and continuous operation of the furnace is initiated, in a conventional manner. Thereafter, lifting roll 19 (driven so as to have a rotational speed synchronized with the line speed of strip 1) is shifted to its uppermost position, lifting metallic strip 1 out of contact and above the critical hearth rolls.

The desirability of having a down position for lifting roll 19 is, of course, only for furnace thread-up considerations. Once thread-up is achieved and roll 19 is shifted to its elevated position 19*a*, it will remain in this elevated position until it is again necessary to shut down the continuous roller hearth furnace 4. In a furnace having sufficient internal access for thread-up, it would be within the scope of the present invention to permanently mount lifting roll 19 in its elevated position 19*a*. Thus, in FIG. 2, index numeral 19*a* could represent the permanent position of roll 19. Such an arrangement would require sufficient access to the interior of the furnace during thread-up as to enable passage of the strip over lifting roll 19 located at position 19*a*. Advantages of such an arrangement include the face that lifting mechanism for roll 19 (such as is shown in FIGS. 5 and 6) could be eliminated. Furthermore, some or all of the critical hearth rolls 14 (FIG. 2) could also be eliminated. In similar fashion, the lifting rolls 52 and 53 of FIG. 7 could also be permanently mounted in their positions shown in that Figure. When the at least one lifting roll is permanently mounted in its elevated position, it is still preferable (although not required) that the roll be driven.

Modifications may be made in the invention without departing from the spirit of it.

What is claimed is:

1. A method of guiding and supporting a strip in a horizontal continuous furnace of the type having a plurality of hearth rolls in parallel spaced relationship and extending transversely of said furnace to tangentially contact and support said strip as it passes through said furnace, comprising the steps of providing a lifting roll in said furnace extending transversely thereof and located at an elevated position, threading said strip through said furnace and over said lifting roll, and initiating continuous passage of said strip through said furnace, and over said lifting roll to lift said strip out of contact with and above some at least of said hearth rolls.

2. The method claimed in claim 1 wherein said strip comprises a metallic strip.

3. The method claimed in claim 1 including the step of driving said lifting roll at a rotational speed synchronized with the speed of said strip as it passes through said furnace.

4. The method claimed in claim 1 including the steps of providing means to shift said lifting roll between a down position at least low enough to be in peripheral alignment with said hearth rolls and said elevated position, and shifting said lifting roll from said down position to said elevated position after threading said strip through said furnace.

5. The method claimed in claim 4 including the step of driving said lifting roll at a rotational speed synchronized with the speed of said strip as it passes through said furnace.

6. In a horizontal continuous furnace for the treatment of strip material and having hearth rolls in parallel spaced relationship and extending transversely of said furnace to tangentially contact and support said strip as it passes through said furnace, the improvement comprising a lifting roll extending transversely of said furnace and located in an elevated position wherein it lifts said strip out of contact with and above some at least of said hearth rolls, said lifting roll having such diameter and said elevated position being such that said lifting roll has a wrap-around contact with said strip when in said elevated position.

7. The structure claimed in claim 6 wherein said strip comprises a metallic strip.

8. The structure claimed in claim 6 including drive means to drive said lifting roll at a rotational speed synchronized with the line speed of said strip.

9. The structure claimed in claim 6 including at least two of said lifting rolls in parallel spaced relationship to each other, the second of said lifting rolls extending transversely of said furnace and located in an elevated position, said second lifting roll having a wrap-around contact with said strip when in its elevated position.

10. The structure claimed in claim 6 wherein said lifting roll is vertically shiftable between a down position at least low enough to be in peripheral alignment with said hearth rolls and said elevated position and means to shift said lifting roll between said down and elevated position.

11. The structure claimed in claim 9 wherein said strip comprises a metallic strip.

12. The structure claimed in claim 9 including drive means to drive said lifting rolls at a rotational speed synchronized with the line speed of said strip.

13. The structure claimed in claim 9 including an intermediate roll located substantially equidistant between said first and second lifting rolls and in parallel spaced relationship thereto, said intermediate roll being located above said hearth rolls, said strip passing over said first lifting roll, under said intermediate roll, and over said second lifting roll as it passes through said furnace.

14. The structure claimed in claim 9 wherein said lifting rolls are vertically shiftable between a down position at least low enough to be in peripheral alignment with said hearth rolls and said elevated position and means to shift said lifting rolls between said down and elevated positions.

15. The structure claimed in claim 10 wherein said strip comprises a metallic strip.

16. The structure claimed in claim 10 including drive means to drive said lifting rolls at a rotational speed synchronized with the line speed of said strip.

* * * * *